US006899921B2

(12) United States Patent
Haenen et al.

(10) Patent No.: US 6,899,921 B2
(45) Date of Patent: May 31, 2005

(54) METHOD FOR REDUCING BACK TRAP MOTTLE AND PAPER WITH REDUCED SENSITIVITY FOR BACK TRAP MOTTLE

(75) Inventors: Jean Pierre Haenen, Eijsden (NL); Maurice Essers, Maastricht (NL)

(73) Assignee: Sappi Maastricht B.V., Maastricht (NL)

( * ) Notice: Subject to any disclaimer, the term of this patent is extended or adjusted under 35 U.S.C. 154(b) by 1 day.

(21) Appl. No.: 10/182,683

(22) PCT Filed: Jan. 29, 2001

(86) PCT No.: PCT/NL01/00059

§ 371 (c)(1),
(2), (4) Date: Dec. 23, 2002

(87) PCT Pub. No.: WO01/54914

PCT Pub. Date: Aug. 2, 2001

(65) Prior Publication Data

US 2003/0124372 A1 Jul. 3, 2003

(30) Foreign Application Priority Data

Jan. 27, 2000 (EP) ..... 00200286

(51) Int. Cl.[7] ..... D01H 17/53; B05D 3/10; B05D 5/04; D21H 17/03; D21H 17/33

(52) U.S. Cl. ..... 427/337; 427/288; 427/411; 427/324; 427/326; 428/195; 162/123; 162/124; 162/127; 162/134; 162/135; 162/136; 162/158; 162/164.1; 162/164.7; 162/168.7; 106/287.23; 106/287.24; 106/287.26; 430/199

(58) Field of Search ..... 427/337, 121; 162/123, 125, 127, 134, 136, 158, 164.1, 168.1, 164.7, 168.7

(56) References Cited

U.S. PATENT DOCUMENTS

| | | | | | |
|---|---|---|---|---|---|
| 3,711,317 | A | | 1/1973 | Bleler | |
| 4,183,766 | A | * | 1/1980 | Woodward | 106/151.1 |
| 4,474,919 | A | | 10/1984 | Polatajko-Lobos et al. | |
| 5,270,378 | A | * | 12/1993 | Johnson et al. | 524/520 |
| 5,380,644 | A | * | 1/1995 | Yonkoski et al. | 430/617 |
| 5,532,121 | A | * | 7/1996 | Yonkoski et al. | 430/617 |
| 5,714,235 | A | | 2/1998 | Takeuchi et al. | |
| 5,736,230 | A | | 4/1998 | Uhlemayr | |
| 5,789,031 | A | * | 8/1998 | Hirabayashi et al. | 427/341 |
| 5,846,381 | A | * | 12/1998 | Wirth et al. | 162/135 |
| 6,387,473 | B1 | * | 5/2002 | Sismondi et al. | 428/32.34 |
| 6,461,422 | B1 | * | 10/2002 | Yang et al. | 106/287.35 |
| 6,623,817 | B1 | * | 9/2003 | Yang et al. | 428/32.12 |

FOREIGN PATENT DOCUMENTS

| | | | |
|---|---|---|---|
| EP | 0 705 704 A2 | | 4/1996 |
| EP | 0 711 672 A2 | | 5/1996 |
| EP | 0 796 947 A1 | | 9/1997 |
| GB | 2 310 215 A | | 8/1997 |
| NL | 1 911 582 | | 9/1969 |
| WO | WO 85/02133 | * | 5/1985 |
| WO | WO 92/03288 | | 3/1992 |
| WO | WO 98/32611 | | 7/1998 |

* cited by examiner

*Primary Examiner*—Vivian Chen
(74) *Attorney, Agent, or Firm*—Hoffmann & Baron, LLP

(57) ABSTRACT

A method for reducing back trap mottle of coated paper, comprising adjusting the absorbency of the coated surface combined with adjusting the adhesion between the coated paper surface and the ink. Polar additives are used in the paper coating to increase the polar fraction of the surface energy. The coated paper has a reduced sensitivity to back trap mottle.

8 Claims, No Drawings

METHOD FOR REDUCING BACK TRAP MOTTLE AND PAPER WITH REDUCED SENSITIVITY FOR BACK TRAP MOTTLE

This application is the U.S. National Phase of International Application Number PCT/NL01/00059 filed on 29 Jan. 2001, which is incorporated herein by reference.

The present invention is in the field of offset printing and relates to a method for reducing the sensitivity for back trap mottle for coated papers. In addition, the invention provides a coated paper for offset print applications, which paper has a reduced sensitivity for back trap mottle.

Back trap mottle is one of the most common problems today for coated papers printed on a multicolour printing press, especially for sheet-offset printing. In so-called multicolour printing, the paper is printed with ink in subsequent printing steps. In each printing step, a different colour is printed. During the transfer of ink from the printing nip to the paper, part of the ink is immobilised on the paper and part of the ink remains free.

Ink may be immobilised immediately within the roughness of the paper and/or by absorbency of the oil phase of the ink by the paper surface.

Conventional (e.g. uncoated) paper has a surface that is not well suited to high speed printing processes, principally because the surface roughness contains all kinds of irregularities and pits. The main purpose of coating of the paper is to provide a smooth surface for printing. Other properties relevant to the coating are receptivity to inks and sufficient surface strength to withstand the forces of the offset printing process. Compositions for the coating of paper intended for offset printing are in general aqueous slurries containing solids. The solids in the coating composition comprise pigments and binders. Pigment is the major component of a paper coating and is usually formed by small white particulate material such as clay (China clay, kaolin), calcium carbonate, titanium dioxide, talcum etc. The pigment particles partially fill the pitted areas in the paper surface, providing for a smooth and suitable printing surface. Binders are starch or synthetic binders that function as glue binding pigment particles to each other and to the paper surface. Examples of commonly used binders are starches and styrene butadiene copolymers. In order to obtain sufficient smoothness and other desirable characteristics such as gloss, papers can be multiple coated, optionally with different coating compositions.

In general, ink particles in offset print processes have diameters in the range between 0.4 and 0.7 $\mu$m. When a paper surface is coated, the roughness of the paper is lower and the pores are smaller. The dimensions of the ink particles are generally larger than the mean radius of the pores of a coated paper (about 0.2 $\mu$m). As a consequence, the immobilisation occurs mainly by the absorbency of oil into micropores and by the permeability of the coating structure.

The roughness of the coated paper surface is very low for multiple blade coated papers. Immobilisation of the ink is therefore even more depending on the absorbency of the paper.

The ink that is not immobilised in the paper, i.e. the free ink, can be taken up by a subsequent printing station for multicolour printing and especially by the non-image area thereof. This free ink can thus be re-transferred to a following sheet. After the passage of a number of sheets a balance is reached between the amount of ink taken up by the blanket of the press and the amount of ink being re-transferred from the blanket to the paper.

When the coating of the paper is inhomogeneous, inksetting may be non-uniform resulting in local variations in the amount of ink re-transferred towards the blanket roll on subsequent printing stations. As a consequence the printed end-product of the offset print process appears mottled. This phenomenon is commonly known as "back trap mottle".

One of the main factors of imbalance between the amount of ink taken up by the blanket and re-transferred to the paper is an uneven coat weight distribution on the paper surface. An uneven coat weight distribution results in an uneven transport of binder towards the surface of the coated paper during the drying step of the coating process and towards the pre-coated base paper: the amount of ink taken up by the blanket and the amount of ink re-transferred to the paper is no longer balanced.

Immobilisation of ink on paper can be enhanced by using a more absorbing coated paper surface. A more absorbing coated paper surface will lead to more ink being immobilized. The more ink is immobilised, the lesser is the amount of free ink that will be available for back-transfer. Without other influences this would theoretically result in a reduced sensitivity for back trap mottle. However, a more absorbing surface increases the cohesive strength (tack) within the ink during printing. If the cohesive strength within the ink exceeds the adhesion between the paper surface and the ink, film-splitting occurs at the paper-surface. Film splitting is the separation of (part of) the ink-layer from the paper-surface. Film splitting near the paper surface will influence the quality of printing in a negative manner. This will result in an increase of sensitivity for back trap mottle in subsequent printing steps and is hence undesirable.

In U.S. Pat. No. 5,736,230, a single-layered paper article is described that is intended for laser printing. Contrary to offset-printing, in laser printing toner is used instead of ink. Toner contains a pigment and a separating agent. In this document it is proposed to add polyethylene glycol as absorbing agent for the separating agent. In laser printing the problem of back trap mottle does not occur.

WO-A-92/03288 teaches a printable paper coating composition comprising inorganic particulate, an aqueous binder of the type of carboxylated stryrene-butadiene copolymers and water insoluble aromatic compounds containing a hydroxyl, ether or ester substituent. Said latter additive is added to improve wet rub, dry pick and/or wet pick. There is no reference to offset print processes wherein the problem or back trap mottle is solved, nor to the polymeric additives to avoid this backtrap mottle problem.

In EP-A-0 796 947 case coated paper for ink jet printing is described. In ink jet printing, the problem of back trap mottle does not occur. The preparation of cast coated paper may give rise to "drum stick", the phenomenon of coating particles that adhere to the surface of a metal cilinder. Drum stick leads to a paper having irregularities at its surface.

EP-A-0 711 672 relates to a recording paper for inkjet and xerography purposes. The paper is coated with inorganic pigments (60–95%) and water based binder (40–5%). A problem that occurs with this type of paper is the blister phenomenon caused by an insufficient gas permeability. By a selected balance of binder and pigment, a certain porosity is adjusted while maintaining a desired gloss.

In EP-A-0 705 704 an image-forming method is described wherein color ink having a surface tension of 25–40 dyne/cm is applied to a glossy recording medium. This medium has a porous structure and includes a pigment a binder and a cationic material that is used as fixing agent for the ink. Improvements in the printability are effected by adjustment of the paper porosity.

U.S. Pat. No. 5,714,235 teaches the fabrication of inkjet paper.

In U.S. Pat. No. 3,711,317, the printability of paper is improved, by the addition of catalytic amounts of higher organic salts and/or stable peroxides dispersed in a coating mass. The additives used promote oxidative drying of the ink.

GB-A-2,310,215 teaches to prepare a coating composition for paper used for printing by a gravure process.

In U.S. Pat. No. 4,474,919 the upward drift in viscosity of alkali-swellable latices is arrested by polyalkylene glycols.

It is a goal of the present application to provide a method for the production of a coated printing paper with a reduced sensitivity for back trap mottle. It is a further goal of the present application to provide for a paper with a reduced sensitivity towards back trap mottle in offset printing.

SUMMARY OF THE INVENTION

It has now surprisingly been found that the incorporation of certain additives at the surface of the paper (coating) and/or in the ink results in a paper with a reduced sensitivity for back trap mottle in offset printing.

Preferably, by incorporating these additives in the coating of the paper, the characteristics of the resulting coated paper are varied in such a manner that a reduced sensitivity for back trap mottle is achieved. In the case of paper coated with multiple layers, each layer is formed from a coating composition which may or may not be of a different composition. The additive is added to at least one of the coating compositions that are applied to the paper. It is preferred to add the additive to the composition that is applied to form the top coating on the paper.

Without wishing to be bound by theory, it is believed that in order to reduce the sensitivity for back trap mottle, it is advantageous to create a certain distribution between the polar and the dispersive fraction of the surface energy.

More in detail, when considering the surface energy of the coating there is a distinction to be made between a dispersive component or fraction and a polar component or fraction of the surface energy. The dispersive fraction generally comprises the VanderWaals forces whereas the polar fraction generally included the polar interactions of the surface. Measurements pointed out that inks can have a polar fraction of about 40%. It is generally known that the adhesive strength between ink and paper increases when the difference between the polar fraction of the surface tension of the ink and the surface energy of the paper decreases. The additives according to the present invention are thought to increase the polar fraction of the surface energy. The polar fraction of the surface energy can be determined by measuring the contact angle between droplets of liquids with a known surface tension (dispersive and polar part) and the surface of the coating. It is within the realm of the skilled man to determine the dispersive and the polar fraction of the surface energy.

The advantageous distribution of the polar fraction of the surface energy can be attained by incorporating additives in the coating composition. These additives migrate (partially) to the surface and hence become surface active. It is thought, without wishing being to be bound to this hypothesis that the additives in the coating of the paper of the present invention increase the polar fraction of the surface energy.

Based on a large group of additives investigated it was found that the additives according to the invention generally fulfil the following main characteristics. Suitable additives in general are polymeric compounds that combine a sufficiently long chain length with functional groups. These functional groups are located at the beginning and the end (telochelic) positions of the polymer and anchor the compound within the coating. The functional group prevent deposition of the polymer during additional steps of the paperproduction process (calendering, cutting). If functional groups are present in the side chains, migration of the polymer to the surface is hindered due to the (large) number of groups. This will not be the case if functional groups are only present in the (telochelic) endgroups. The additional long chain length is necessary to enable that part of the polymer to orientate along the surface. At the surface the compound may exert. At the surface the compound may exert its surface activity and influence the polar fraction of the surface energy.

The additives are preferably selected from the group of polymers that contain oxygen atoms in the main chain. Examples are polyethers and polyesters.

Functional groups that are considered strongly interacting with the components of the coating such as the binders, are functional groups that can have an ionogenic interaction with the other components of the coating. Strongly basic (anionic) substituents (such as $COO^-$) may serve as examples of groups that can exert ionogenic interactions.

It is noted that functional groups that contain a strongly acidic proton (such as —COOH) can become deprotonated in the alkaline environment of the coating and hence will interact in the form of the conjugated base.

Other functional groups that are considered strongly interacting with the other components of the coating composition are groups that react strongly basic. Examples thereof are groups that contain $—NH_2$, —NHR, $—NR_2$-groups or (cationic species) other groups that form quaternary ammonium compounds. Other suitable endgroups are capable of the formation of H-bonds. Examples of these groups are —OH, —SH etc.

If the polymeric additive contains substituents in side chains which are similar or identical to the requirements for functional groups described previously, the substituents in the side chain will, just as the functional groups, interact with the coating composition. The additive will not only be anchored at the telochelic positions but also on positions in between. By anchoring of the polymeric additives through substituents in the side chain the migration of the polymer chain to the surface is hindered. For this reason polymeric additives with side chains are not desirable as they can hinder migration to the surface of the coating.

The additives are preferably selected from the group of polymers that contain oxygen atoms in the monomeric units of the main chain. It is thought, without wishing to be bound thereto, that by the intermolecular interactions (H-bond formation, dipole-dipole interactions and Lewis acid-base interactions) of the oxygen atom, the polar fraction of the surface energy can be increased. Other heteroatoms such as N, Si, P or S are possible but are not preferred in the polymeric main chain. A preference exists for linear unbranched polymers, with a further preference for polymers that are stable in an alkaline environment.

A group of compounds that are exemplary additives according to the invention are non-ionic surfactants.

The polymeric additives are added to the coating composition in an amount that creates the desired balance between the polar fraction and the dispersive fraction of the surface energy. Furthermore, when the polymer is not or reduced soluble in water it is desirable that the polymeric additive has a glass transition temperature that is sufficiently low to allow the application of the polymer in coating compositions for paper.

Generally polymers that are suitable in the present invention will have glass transition temperatures that are below −80° C. Preferred melting temperatures will be below 30° C., preferably below 10° C. A melting temperature below −5° C. is highly preferred.

The molecular weight of these additives is general between 1000–50000, preferably between 2000 and 25000, most preferably between 3000 and 15 000. A molecular weight of more than 4000 is highly preferred.

The additives that are being used in the method according to the present invention are non-ionic surfactants. They are preferably selected from the group consisting of polyethers and polyesters, preferably saturated polyesters. A preference for linear polymers is noted. In a preferred embodiment, the additives are selected from the group consisting of polyethylene glycols, polypropylene oxides and copolymers thereof, polytetrahydrofuran, aliphatic saturated polyesters and mixtures thereof.

Examples of these additives are Polytetrahydrofuran 2000 from BASF, Desmophen 1915 U from Bayer (a polypropyleneoxide with a Mw of 4800) and Genapol from Clariant (ethyleneoxide/propyleneoxide copolymers). Suitable polyesters are available from DSM, Heerlen, the Netherlands under the brandnames Uraplast S5561, S5640, S 5703.

Especially polyethylene glycols with a molecular weight in excess of 1000, preferably 2000 to 15000 are preferred. Examples of these polyethylene glycols that are commercially available are polyethylene glycols under the name of Permaid (molecular weight 10000) and Permanol (molecular weight 3000).

By including additives in the coating composition, the characteristics of the resulting coating and thus of the paper are influenced. This influences not only the absorbency of the coated paper towards the ink but also the adhesion between the ink and the coated paper.

The effect of adjusting the polar fraction of the paper is that in general the absorption of the ink by the paper will increase. The adhesion between the paper and the ink will also increase. As stated above, an increased absorption also increases the cohesive strength within the ink.

In contrast to the conventional approach depicted above, which held that a high cohesion of the ink would have a negative influence (via film-splitting) towards the sensitivity for back trap mottle, the reverse effect is achieved according to the present invention.

It has hence surprisingly been found that, and this is an important aspect of the present invention, depending on the adhesion between the ink and the paper, a reduced sensitivity towards back trap mottle can be achieved by an increased absorbency of the surface coated paper without the negative effect from the increased cohesion of the ink.

A combination of stronger adhesion between the ink and the coated paper and a stronger cohesion of the ink results in a coated paper that in a printing process expresses a reduced sensitivity towards back trap mottle.

DETAILED DESCRIPTION OF THE INVENTION

A fist aspect of the invention accordingly relates to a method for a coated paper with a reduced sensitivity for back trap mottle, comprising increasing the absorbency of the coated paper surface and simultaneously increasing the adhesion between the coated paper surface and the ink.

More in detail, by the measure of the present invention back trap mottle is reduced because the amount of free ink is reduced. That is, the amount of free ink is reduced by increasing the absorbency of the coated paper surface and increasing the adhesive strength of the paper surface. The absorbency and the adhesion are adjusted simultaneously. In this manner a balance is achieved between the forces within the ink and the forces between the ink and the paper surface, resulting in an overall reduced sensitivity for back trap mottle.

In a preferred embodiment of the method of the present invention the sensitivity for back trap mottle is reduced by adjusting the adhesion between the coated paper and the ink by adjusting the polar fraction of the surface energy. In general, without wishing to be bound by any theory, it is assumed that the adhesion between the ink and the paper is optimal if the polar fraction of the surface energy of the paper is in the same order as, and preferably equals the polar fraction of the surface energy of the ink. As the fraction of the polar part of the conventionally used ink is generally higher (generally 25 to 50%) when compared to the fraction of the polar part of the conventionally used paper-surface, it is possible to increase the polar fraction of the surface energy of the paper or to decrease the polar traction of the surface energy of the ink or both. It is preferred to increase the polar fraction of the surface energy of the paper surface.

According to a further embodiment of the invention, the polar fraction of the surface energy is increased by the incorporation of polar additives in the form of the nonionic surfactants described previously.

In a preferred embodiment of the present invention, the polar additives according to the invention are added to the coating composition which is subsequently applied to the paper. The additives are added to the coating composition in an amount of 0.1 to 5 parts (dry weight on 100 parts of dry weight pigment), preferably between 0.2 and 2.5 parts.

The upper and lower limits for the amount of polar additives depend on the paper. The lower limit will generally be given by the amount of polar additives which do not result in a reduction of the sensitivity towards back trap mottle. The upper limit may depend on more variables. For instance, in the case of a combination of a paper coated with too large an amount of a polyethylene glycol it was found that in the case of an ink with a bad or low solvent resistance (such as for instance Reflex Blue) a discoloration (fading/bleeding of the ink) occurred. A polyester additive has been found to be a polar additive that creates no or at least less sensitivity towards fading/bleeding and at the same time provides a reduced sensitivity towards back trap mottle. In a preferred embodiment, the polar additive is a polyester, preferably saturated polyesters such as Uraplast S 5561, S 5640 and S 5703 (obtainable from DSM, Heerlen, the Netherlands). These polyesters improve mottle without causing fading or bleeding for inks with a bad solvent resistance (e.g. Reflex blue).

The method according to the invention can be applied to both sides of the coated paper with some optimisation that can easily be carried out by the skilled man.

Furthermore, and within the scope of the invention, the sensitivity for back trap mottle is reduced using the additives according to the present invention either alone or in combination.

There is a general limitation to the simultaneous increase of the adhesion between the paper and the cohesion within the ink: the pick-resistance. Picking is the separation of the ink from the paper at or even below the paper surface. If both of the adhesion and cohesion forces mentioned exceed the strength of the coated layer or the internal bond of the base-paper picking will occur. Dependent on the ink and papertype used, a person skilled in the art can after taking into account the teaching of the present description easily determine this pick resistance for the additive(s) used.

Description of the Test Methods.

Prüfbau ("Prüfbau" is a product name of Prüfbau, München, Germany) is used for evaluating back trap mottle. The paper is printed during the first pass with a blue sheet offset ink followed by 5 passes contacted with a clean blanket roll. Judgement of the test strips was made by comparing them with a standard range used for judging the quality of every reel produced in the Maastricht Mill of Sappi. This range is based on many years experience and proved to correlate very well with praxis printing tests on conventional commercial presses. A higher value for the mottle indicates less sensitivity for back trap mottle (7 means mottle free, 6 mottle just sufficient, 5 mottle unsatisfactory).

The Ink Surface Interaction Tester (ISIT, a product of Segan Ltd. Perrose, Lostwithiel, Cornwall UK) is used for measuring the tack of a blue sheet offset ink as function of ink setting time. Density measurements carried out on the test strips at the individual pull-off points are used to judge the ratio between the cohesive force in the ink and the adhesive force between ink and paper. A lower density indicates a film-splitting near the paper-surface. The density in the neighbourhood of the tack maximum gives information about the ratio between cohesive and adhesive forces. For each setting time the density is measured on the left, middle and right position respectively and this for three different test strips. For the density value used for the evaluation the mean of nine values is taken.

The density measurements on the rest strips are made with the Macbeth RD920 (Macbeth, Great Britain) measuring equipment using a blue filter.

Surface energy measurements are carried out with the Fibro Dat 1000 (Fibro Systems AB, Hagerstein Sweden) to determine the polar fraction and the dispersive part (vanderWaals forces) of the surface energy. Droplets of fluid were brought on to the surface of the coating and the contact angle between the droplet and the surface measured. To determine the potential dispersed part of the surface energy, water and bromonaphthalene was used. The measurements were carried out on a time scale between 0.03 s and 0.1 s. Due to the absorbency of the coated paper-surface longer times are not suitable to measure contact angles of the droplets due to the physical loss of fluid during the measurement. After 0.03 s disturbance of the measurements due to vibrations caused by the falling of the droplet can be considered minimal and therefore ignored. The values for polar fraction and dispersive part are taken as the mean of 7 measurement points in the time interval 0.03 and 0.1 s. During this interval the data were fairly constant.

To determine the pick resistance of the paper "multi-colour micro-picking" is determined with the Prüfbau using a standard medium-tack red ink Rupf Testfarbe picking test ink no. 408002 and using aluminium reels.

EXAMPLES

Pilot coater trials at Pluss Staufer (Switzerland, Oftringen carried out for 300 g/m$^2$ triple blade coated woodfree demi-mat paper (sheet offset). The first two blade coatings were applied in the Mill (respectively Maastricht and Grathorn), the top-coating (12 g/m$^2$) was applied at the pilot coater at a speed of 650 m/min.

The polar fraction of the surface tension is varied by adding special additives to the coating applied to the paper and the porosity of the paper coating by changing the binders. For each series no variations were made in the pigments and co-binders of the coating formulations and in drying conditions. The formulation of the coating is based on a conventional coating and comprises

| Pigment | |
|---|---|
| $CaCO_3$ | 100% |
| Binders | based on dry weight per 100 parts of dry weight pigment |
| Styrene-butadiene latex | 7% |
| Starch | 2.5% |
| carboxymethylcellulose | 0.1% |
| polyvinylalcohol | 1% |
| cross-linker | 1% |

To this coating composition the additive is added and applied to the paper.

TABLE 1

| Exp. | Additive | Latex binder | Mottle | ISIT 1 | ISIT 2 |
|---|---|---|---|---|---|
| nr 1 | 0.8 parts Ca-Stearate | Styrene-Acrylic $T_g$ 15° C. | 5.5 | 95 | 110 |
| nr 2 | 1.5 parts Permanol | Styrene-Acrylic $T_g$ 15° C. | 6.5 | 101 | 114 |
| nr 3 | 1.5 parts Permaid | Styrene-Acrylic $T_g$ 15° C. | 7– | 96 | 111 |
| nr 4 | 1 part Permaid | Styrene-Acrylic $T_g$ 15° C. | 7– | 98 | 120 |
| nr 5 | 0.8 parts Ca-Stearate | Styrene-Butadiene $T_g$ 10° C. | 5+ | 92 | 102 |
| nr 6 | 0.8 parts Ca-stearate | Styrene-Butadiene $T_g$ 16° C. | 5– | 92 | 104 |

1. Density ISIT test stripe: ink-setting time 32 s
2. Density ISIT test stripe: ink-setting time 115 s The positive effect on back trap mottle realised using the additive polyethylene glycol has also been shown on production scale in the Maastricht Mill.

Additionally a number of additives were investigated on a laboratory scale. For these investigations paper was top-coated with an Enz coater at a speed of 10.5 m/minute. The formulation of the coating is similar to that previously described. The results are presented in Table 2.

Fading Tests: To test the sensitivity for fading/bleeding papers were printed with critical inks (e.g. Reflex Blue) and submitted to the following conditions:

1. The printed sheets (laboratory and commercial) were stored in air, after 18 weeks for laboratory printed paper ad after 5 weeks for commercially printed paper fading/bleeding was determined visually.

2. The printed sheets were stored in boxes with different relative humidities.

3. The printed sheets were treated with steam.

All tests were performed with two inks, a green Pantone ink (a mixture of yellow pint and Reflex Blue) and an ink containing 50% Reflex blue and 50% Transparent White.

Inks containing a higher amount of reflex blue are more sensitive to fading bleeding than diluted inks with reflex blue. Under normal conditions (room temperature in air) fading/bleeding only occurred for the Permaid paper after several days. More extreme conditions resulted in some sensitivity for fading bleeding of Desmophen and PTHF. All polyesters do not show a significant sensitivity to fading/bleeding. The theoretical explanation of the phenomenon or a mechanism of fading/bleeding which was induced when polyethylene glycol is used in the coating formulation is the migration of counter-ions from the original pigment. This results in a change in the configuration of the molecule Alkali Blue resulting in a change of color.

The affect of Uraplast 5661 LP on the reduction of back trap mottle has also been proven on Mill scale application.

TABLE 2

| Exp. No. | 7 | 8 | 9 | 10 | 11 | 12 | 13 | 14 |
|---|---|---|---|---|---|---|---|---|
| Additive | | | | | | | | |
| permaid | | 1.50 | | | | | 0.80 | |
| calciumstearate | 0.80 | | | | | | | |
| uraplast 5561 | | | | | 1.50 | | | 1.50 |
| uraplast 5640 | | | | | | 1.50 | | |
| desmophen | | | 1.50 | | | | | |
| pthf 2000 | | | | 1.50 | | | | |
| Results | | | | | | | | |
| Prufbau | | | | | | | | |
| Mottling ob | 4.50 | 6.00 | 6+ | 5.00 | 6.50 | 6+ | 5.50 | 5.50 |
| Mottling ws | 5.00 | 6.00 | 6+ | 5+ | 7− | 6.50 | 5.50 | 5.50 |
| mottle praxis 6 colors | 5.50 | 6.00 | 6.50 | 5.50 | 6.75 | 6.75 | 5.50 | 5.75 |
| mottle praxis 4 colors | 6.00 | 6.25 | 6.75 | 6.25 | 7.00 | 7.00 | 6.50 | 6.75 |
| Multicolormicropick fs | >6 | >6 | >6 | >6 | >6 | >6 | 6 | 6 |
| Multicolormicropick ws | >6 | >6 | >6 | >6 | >6 | >6 | 6 | 6 |
| fading reflex blue | | | | | | | | |
| room temperature | no | yes | no | no | no | no | yes | no |
| humidity 55% | no | yes | no | no | no | no | yes | no |
| humidity 88% | no | yes | yes | no | no | no | yes | no |
| steamtest | no | yes | no/yes | no/yes | no | no | yes | no |
| fading/green pantone ink | | | | | | | | |
| roomtemperature | no | yes | no | no | no | no | yes | no |
| humidity 88% | no | yes | yes | no | no | no | yes | no |

What is claimed is:

1. A method for offset printing comprising applying ink by a conventional offset printing technique on a coated paper with a reduced sensitivity for back trap mottle, said paper having a coating which contains at least one polar additive in an amount sufficient to increase the absorbency of the coated paper surface for said ink and simultaneously the adhesion between the coated paper surface and said ink.

2. Method according to claim 1, wherein the adhesion is increased by increasing the polar contribution of the surface energy of the coated paper surface.

3. Method according to claim 2, wherein the polar contribution of the surface energy of the coated paper is adjusted to be in the same order as the polar contribution of the surface energy of the ink.

4. Method according to claim 3, wherein the polar contribution of the surface energy of the coated paper is adjusted to be substantially equal to the polar contribution of the surface energy of the ink.

5. Method according to claim 2, wherein the at least one polar additive is a nonionic surfactant.

6. Method according to claim 2, wherein the at least one polar additive is selected from the group consisting of a polyethylene glycol, polypropylene oxide and copolymers thereof, polytetrahydrofuran, polyester and mixtures thereof.

7. Method according to claim 1, wherein the at least one polar additive is incorporated in an amount of 0.1 to 5 parts (dry weight on 100 parts of weight of pigment).

8. Method according to claim 7, wherein the at least one polar additive is incorporate in an amount of 0.2 to 2.5 parts (dry weight on 100 parts of dry weight of pigment).

* * * * *

UNITED STATES PATENT AND TRADEMARK OFFICE

CERTIFICATE OF CORRECTION

PATENT NO. : 6,899,921 B2
DATED : May 31, 2005
INVENTOR(S) : Haenen et al.

It is certified that error appears in the above-identified patent and that said Letters Patent is hereby corrected as shown below:

Column 5,
Line 58, now reads "A fist aspect" should read -- A first aspect --.

Column 6,
Line 19, now reads "to decrease the polar traction" should read -- to decrease the polar fraction --.

Column 7,
Line 29, now reads "measurements on the rest strips" should read -- measurements on the test strips --.

Column 10,
Line 30, now reads "dry weight on 100 parts of weight of pigment" should read -- dry weight on 100 parts of dry weight of pigment --.

Signed and Sealed this

Twentieth Day of September, 2005

JON W. DUDAS
*Director of the United States Patent and Trademark Office*